US006864469B1

(12) United States Patent
Chaskin

(10) Patent No.: US 6,864,469 B1
(45) Date of Patent: Mar. 8, 2005

(54) APPARATUS AND METHOD FOR FABRICATING DRY CELLS INTO BATTERIES USING R F INDUCTION HEATING

(76) Inventor: Jeffrey R. Chaskin, 841 NW. 126 Ave., Coral Springs, FL (US) 33071

( * ) Notice: Subject to any disclaimer, the term of this patent is extended or adjusted under 35 U.S.C. 154(b) by 0 days.

(21) Appl. No.: 10/657,077

(22) Filed: Sep. 9, 2003

(51) Int. Cl.[7] ..... H05B 6/10
(52) U.S. Cl. ..... 219/603; 219/633
(58) Field of Search ..... 219/603, 601, 219/633, 635, 676, 632, 91.1; 29/730, 623.1, 623.2, 623.4; 228/58, 901; 425/116, 774, 174, 8 R; 429/231.95, 101; 264/42; 252/182.1; 427/123; 204/192.15

(56) References Cited

U.S. PATENT DOCUMENTS 4,186,246 A 1/1980 Sugalski
4,262,414 A 4/1981 Sugalski
4,306,355 A 12/1981 Hawrylo et al.
4,322,597 A * 3/1982 Hooke ..... 219/91.1
4,501,943 A 2/1985 Lund
4,523,068 A 6/1985 Lund et al.
4,642,442 A * 2/1987 Mullane et al. ..... 219/603
5,558,950 A * 9/1996 Ovshinsky et al. ..... 429/101
5,834,743 A * 11/1998 Lund et al. ..... 219/633
5,836,371 A 11/1998 Kump et al.
5,886,325 A 3/1999 Lund

* cited by examiner

*Primary Examiner*—Quang T. Van
(74) *Attorney, Agent, or Firm*—Kenneth E. Merklen

(57) ABSTRACT

Dry cells are combined in both physical and electrical combination to fabricate a battery. A dry cell strap defined by a solid copper core with a skin or cover of chrome steel bonded to the copper core, is soldered to terminals of adjacent dry cells using induction heat developed by an oscillator/generator operating in the R F frequency range of frequencies. The parts of the dry cell terminal and cell strap which are soldered together are inserted into alignment with the coils of a coil which generates a magnetic field for inducing a heat creating current in the parts aligned with the coils. Virtually immediate temperature elevation throughout the parts in the coil is achieved and soldering is accomplished without applying excess heat to any one part thereof. Heat elevation in the parts to be soldered, is kept to a minimum. The increment of time during which the temperature of the parts is elevated is minimized.

9 Claims, 2 Drawing Sheets

APPARATUS AND METHOD FOR FABRICATING DRY CELLS INTO BATTERIES USING R F INDUCTION HEATING

BACKGROUND OF THE INVENTION

1. Field of the Invention

This invention relates to apparatus and methods for soldering straps to terminals of electric dry cells for fabricating dry cell batteries. In particular, the invention relates to the use of microwave induction or R F induction heating for connecting, both physically and electrically, a plurality of electric dry cells for forming a dry cell battery.

2. Prior Art

In the field of toys, radio controlled toys, such as self propelled, remote controlled airplanes, boats and land vehicles such as cars, trucks and other vehicles, for example, have become very popular. Them vehicle has its own power plant which is usually in the form of a gasoline engine or an electric motor. When electric motors serve as a power plant for such toy vehicle, the onboard power supply or 'fuel' is usually a rechargeable, interchangeable electric battery of the dry cell type. The rechargeable, interchangeable electric dry cell battery is a fabrication of several connected electric dry cells, normally referred to as 'dry cells'. The dry cells are coupled together both electrically and physically, made as compact as technology allows.

In fabricating an electric battery from a plurality of electric dry cells a strap of highly conductive material in the form of a strap, for example, is connected, usually by soldering, to the terminals of adjoining electric dry cells. Contemporary methods used for fabricating a rechargeable electric dry cell battery from a plurality of rechargeable electric dry cells includes the use high temperature conduction or 'hot-tip' soldering, flame generated heat soldering or welding, which heats the connection strap and the terminal to which the strap is to be soldered to an high elevated temperature so as to melt soldering material at the connection between the terminal and the connection strap. Often the use of hot-tip soldering or conduction causes problems not apparently visible. It is well known that heat is an enemy of electric dry cells. Heat destroys the chemical balance in the electrolyte matter in the dry cells and drives the electrolyte matter, and hence the dry cell into deterioration. When hot-tip soldering is used to solder a connection strap to a terminal of a dry cell, a film of solder is often applied to the under side of the end section of the strap which will be connected to the terminal. In order to effectively solder-connect the two pieces, the two pieces must be in physical contact during the soldering effort. This requires that the hot-tip of the soldering tool must be placed in contact with some other part of the strap. From a practical standpoint, the hot tip of the soldering tool is placed in contact with the upper side of the strap, above where the strap and the terminal are placed into contact. This requires that the high heat or energy, at the tip of the soldering tool, be transferred to the outer side of the strap, travel through the thickness of the strap, through the solder between the strap, be transferred to the terminal at the junction with the strap and heat the terminal of the cell at least to a temperature sufficiently high to be acceptable to receive the heat liquified solder. It becomes obvious that at least some of the heat energy is wasted and that some parts of this combination are heated much more than other parts. If the cell terminal, which is driven to the lowest heat level of the connecting pieces, is not heated to a high enough level the solder connection will fail. If the cell terminal is heated to an excessively high level, the heat in the terminal will adversely affect the electrolytic matter in the cell and drive the cell to early deterioration, shortening the life of the cell and the battery of which it is a part.

It becomes apparent that the quantity of heat actually applied to the outer side of the strap during the soldering effort is greatly in excess of the heat required to raise the temperature of the terminal to a degree where the terminal is in a condition to accept the solder so that the terminal and the strap may be physically and electrically connected by the solder. Because much heat applied to the outer side of the cell strap in the hot-tip soldering process is lost by absorption by the strap components, the solder, by transfer of heat and by the terminal components, fabrication of dry cell batteries from a plurality of electric dry cells is expensive.

A welding tool has been used as the primary source of heat for spot welding a strap to the terminal of a dry cell for fabricating a dry cell battery. However, the use of spot welding in the fabrication of dry cell batteries has been found unreliable because a spot weld contact is not an excellent electric conductor, which is needed for the rapid discharge to which the batteries are subjected when the battery is used to power an electric motor in a toy vehicle, when racing the vehicle. The unacceptability of the single spot weld connection between a cell strap and the terminal of a dry cell battery lead to the use of additional spot welds, for example to the use of an average of five spot welds. The increase in the number of spot welds to such a small area became destructive to the strap and very costly. Also when spot welding a cell strap to a terminal of a dry cell, an electric charge is the vehicle that generates the heat for the welding. The electric charge driven through the dry cell for the spot welding has an adverse effect on the chemical electrolyte material in the dry cell that stores electric energy. One driving charge is a commercially acceptable adverse effect but multiple driving charges from a plurality of closely applied spot welds on the same small area, have an unacceptable adverse effect on the life of the dry cell, which translates into an unacceptable adverse effect on the life of the battery of which the dry cell is a part.

SUMMARY OF THE INVENTION

The present invention provides a microwave generator, preferable in the radio frequency range of frequencies and a coil connected to the microwave generator for generating electromagnetic energy about the coil. Preferably, the coil is open and adapted for receiving the mass of an end portion of a dry cell strap and the exposed terminal of a completed electric dry cell, held together, in physical contact so that the electromagnetic energy generated by the coil is induced into the conductive materials of the dry cell strap and exposed dry cell terminal for establishing a current in the members sufficient for heating those parts of the members in the coil, to a solder-liquefying temperature for soldering the dry cell strap to the cell dry terminal. The invention provides a cell strap with unique characteristics. Soldering the dry cell strap to the dry cell terminal is accomplished when the dry cell is a complete entity.

It is well known that microwave energy travels on the skin of conductive material. It is also well known that the more conductive the material, the less heat generated by induction heating. Copper, for example, is an excellent conductor of electricity, has poor magnetic characteristics and is a poor generator of heat in an induction heating environment.

While iron and compounds there of such as nickel-steel or chrome-steel, for example, are each fair to good conductors of electricity, each has excellent magnetic characteristics and are good to excellent heat generators in an induction heating environment. The present invention provides a dry cell strap, which is used for connecting terminals of adjacent dry cells both electrically and physically. The dry cell strap is fabricated in clad material form, for example, a copper core on the inside and a skin or coating of chrome-steel bonded to the outer surface of the copper core. This combination provides a dry cell strap, for connecting terminals of adjacent dry cells, which has a core having excellent conductive characteristics for low frequency electric energy, which energy travels through the core of a conductor, and a cladding or skin bonded to the core, having reasonably good to excellent conductive characteristics for high frequency electric energy, which energy travels on the skin of a conductor. The thickness of the skin bonded to the core may be five thousands (0.005) to eighteen thousands (0.018) of an inch, for example, sufficiently thick for conducting high frequency electric energy while being thin enough to lack resistance to the passage of low frequency electric energy between the strap and the teal, through the soldered connection. The clad material, over the copper core, must be excellent for generating heat in an induction heating environment and sufficiently thick to hold the heat, for soldering purposes and cool off rapidly. An outer skin of chrome-steel approximately 0.015 of an inch thick is recommended although other metals and/or thicknesses may be used. The core of the dry cell strap is preferably of solid copper, one eighth (0.125) of an inch thick and three eights (0.375) of an inch wide. Although the size of the core is limited by the energy value expected to be drawn from the battery, the thickness and/or width of the copper core depends on the strength of the cover or skin bonded to the core, since the core must carry low frequency energy and also assist by supporting the outer bond material in physically containing adjacent dry cells in a predetermined dry cell battery configuration. The length of the dry cell strap depends on the diameter of the dry cells forming the battery. The dry cell strap must be sufficiently long to bridge the terminals of adjacent dry cells, with areas at each terminal sufficiently large for solder-bonding the strip to the terminal.

Soldering a dry cell strap to the terminal of an active dry cell using R F induction heating has several advantages over conduction heating, such as hot-tip or soldering tool heating and open torch or flame heating, for example. R F induction heating is the heating of electrically conductive material by a current induced in the material. Heat generated by R F induction methods is immediately established in all the material in the magnetic field. Functionally, inductive heat is generated in all the materials in the magnetic field at the same time. This avoids applying excessive heat to one spot or area on a member with transfer and dissipation of heat between joined members, using conductive heating, as with a soldering tool for example. Heating is almost immediate and is as uniform as the different characteristics of the different materials will permit. The degree or quantity of heat generated is a function of the electric conductivity and the magnetic characteristics of the materials in the magnetic field and the frequency and energy applied to the coil generating the magnetic field. The materials used may be selected for closeness of corresponding characteristics. The frequency range, the energy level and the period of time the energy is applied to the coil and thus to the materials in the coil, are functions of accomplishment using the selected materials. That is, enough to accomplish the desired job without undesirable side effects on the dry cell. By adding a film of solder to the surface of the dry cell strap that makes contact with the dry cell terminal, influence of the current induced in the in the strap, in the solder film and in the terminal that are in the coil provides an heat that is virtually immediate and uniform and will liquify the solder for bonding the strap to the terminal. When the temperature of the heat is reduced, the solder will solidify, binding the dry cell strap to the dry cell terminal. The time the R F generator is activated is controlled by a timer, which time increment may be uniform for each succeeding process. Use of excessive heat to accomplish the solder bonding is avoided. Undesirable side effects on the bonding, the dry cell strap and the dry cell are virtually eliminated.

Examples of induction heating generators are taught in the prior art, by Lund in his U.S. Pat. No. 5,886,325 issued on Mar. 23, 1999. Lund teaches the use of induction heating to fuse the lead terminal post connected to the internal cells of the battery, to a bushing embedded in the material of the casing that supports the cells of the battery. In his teaching, Lund includes the construction and assembly of lead acid storage batteries using induction heating heat-fise parts of a lead acid storage battery. This is accomplished during the assembly and construction process of the case of a lead acid battery. A lead acid electric storage battery is greatly distinguishable from a battery made from a plurality of independent dry cells.

Lund, in his '325 teaching mentions two patents which are prior art to his '325 teaching, U.S. Pat. No. 4,501,943 issued to Lund on February 26, 1985 and U.S. Pat. No. 4,523,068 issued to Lund et al on Jun. 11, 1985. Both these patents teach the fusing of battery parts of a lead acid storage battery during the construction phase of the battery. A lead terminal post, connecting to the internal cells in the casing, is fused to a lead bushings embedded in the cover of the casing supporting the battery, for sealing the case of the battery. The fusing process is accomplished by induction heating. These two latter patents mentioned by Lund, are limited in that the teaching of Lund, '943 and Lund et al, '068 is that the inducting heating is a construction phase of a lead acid electric storage battery, not fabricating a battery from independent dry cells. Lund teaches the use of induction heating for fusing a terminal post to a bushing embedded in the casing when the lead acid electric storage battery is in the assembly stage and the electrolyte of the battery is absent. Thus, in the prior art mentioned above, the fusing of a terminal post to a bushing is done during assembly, on a partially complete lead acid storage battery. The present invention provides for the soldering of an independent member, a dry cell strap, to a terminal of an independent, complete dry cell using inductive heat generated by a current induced in a portion of a dry cell strap and in a portion of a dry cell terminal of a completed, independent dry cell by energy from a spaced coil connected to a microwave generator.

DETAILED DESCRIPTION OF THE INVENTION

Figure 1:
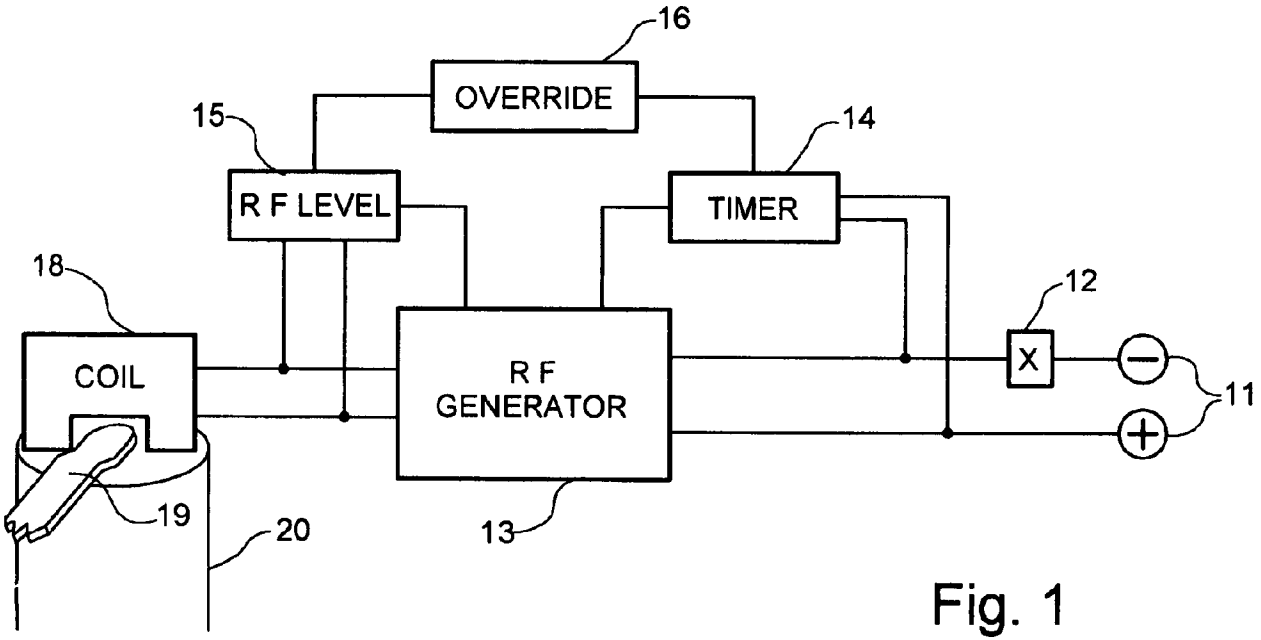
FIG. 1 is a block diagram representing the invention.

FIG. 1 represents, in block form, one aspect of the invention, the solder bonding of a connector strap and/or connector strip to a terminal of a dry cell for forming a battery from the dry cells, using induction heating, in the radio frequency range of frequencies. An induction heating device may include a power supply 11, which drives the generator or oscillator block 13 R F GENERATOR, in the radio frequency range of frequencies. Block X 12, represents a master switch for the generator. An adjustable timer, block 14, TIMER (ADJUSTABLE) connects to the generator and controls the time increments during which the generator is run or activated. The timer is adjustable, and, when adjusted to time an increment for activation, the generator will run for adjusted increments of time. The block 15, R F LEVEL monitors the output energy level, which monitor is also adjustable to maintain a desired level of energy output by the generator. The RF Level monitor may be provided with a control for cutting off the generator in the event that the energy output of the generator exceeds a preset maximum or if the output energy is below a preset minimum energy level. Block 16, OVERRIDE, serves as an emergency cut off, when needed.

The RF energy output of the generator is applied to a coil, block 18, COIL, which generates a magnetic field about the coil, when driven by the generator. The field about the coil induces a current in materials in the magnetic field. A dry cell 20 and a dry cell strap 19 are represented with a portion of each member in the split or opening of the coil.

Figure 2:
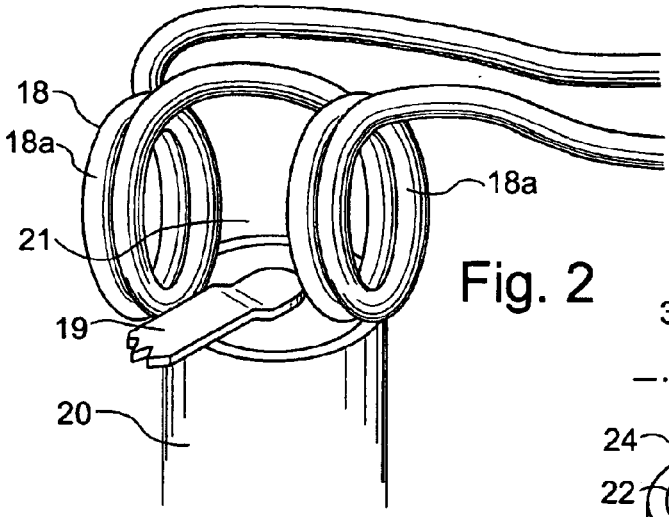
FIG. 2 represents, in pictorial view, an R F induction coil adapted to, and receiving, a dry cell strap and dry cell terminal.

FIG. 2 shows, in more detail, a preferred embodiment of the coil 18. The coil 18 is fabricated from a copper tubing so that the coil is hollow and may contain therein a coolant, preferably a liquid coolant. The ends of the tubing are sealed and the ends are connected to the R F Generator. The coils of the coil 18 are open or split at 21, for example, for providing an egress for inserting and withdrawing a mass into an alignment with the coils 18*a* of the coil 18. As provided for herein, a portion of the post terminal, 22, extending from the body of the dry cell 20 and a portion of the dry cell strap 19, are inserted into an aligned position with the coils forming the coil 18 through the split 21. The split 21 may be opened enough to permit insertion of the can of the dry cell, as discussed below. A connection strip may be substituted for the dry cell strap also as discussed below.

Figure 3:
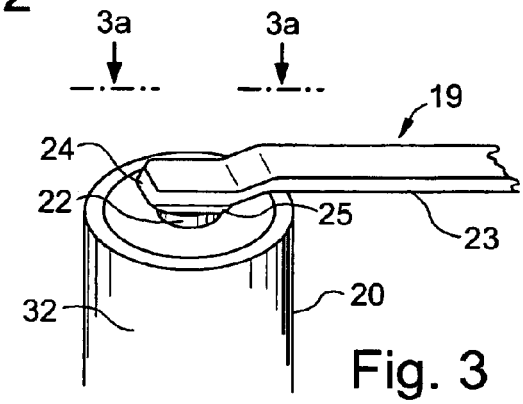
FIG. 3 represents, in side elevation view, a dry cell strap bonded to a terminal of a dry cell.
Figure 4:
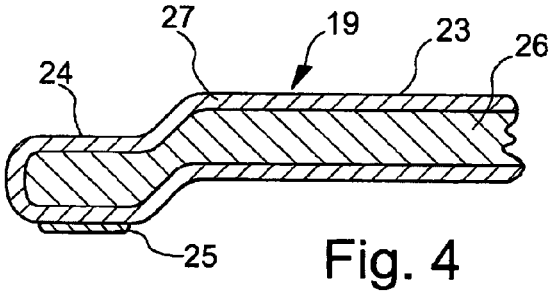
FIG. 4 represents, in cross section view part of a dry cell strap of clad construction, usable in the invention.
Figure 3A:
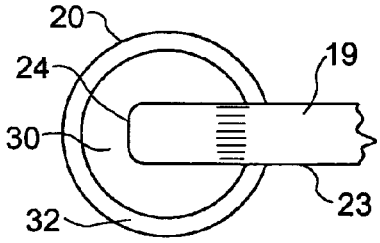
FIG. 3*a* represents, in plan view, the dry cell strap and the dry cell represented in FIG. 3, as viewed along line 3*a*—3*a* of FIG. 3.

Attention is directed to the FIGS. 3, 3*a* and 4 which show a dry cell strap 19 bonded to the terminal post 22 of a dry cell 20. The dry cell strap, which is shown in part, includes a bridge 23 and a toe 24 at one end of the bridge. A second toe (not shown) is on the other end of the bridge and is similar to the toe shown. The under surface of the toe makes contact with the top of the post terminal, or with the can. Preferably, a thin film of solder 25 is laid on the under surface of the toe. During the induction heating process, the solder melts and bonds to both the under side of the strap and the top of the post terminal, as shown in FIGS. 3 and 3*a*, and FIGS. 5 and 5*a*.

FIG. 4 represents a portion of a preferred embodiment of a dry cell strap, shown in cross section view. The strap 19 includes an inner core 26 and an outer skin or cladding 27 bonded to the core. The inner core is a copper metal and the outer skin is a chrome steel material. The toe 24 of the strap is at the end of the bridge 23 and has a film of solder 25 laid on the under surface of the toe. The film of solder will actually come in contact with the terminal to which the strap is to be soldered.

Figure 5A:
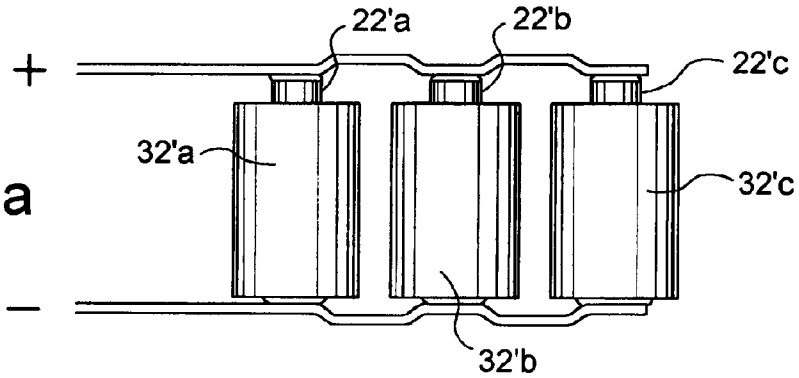
FIG. 5*a* represents another form of dry cell battery using three dry cells in parallel connection.
Figure 5:
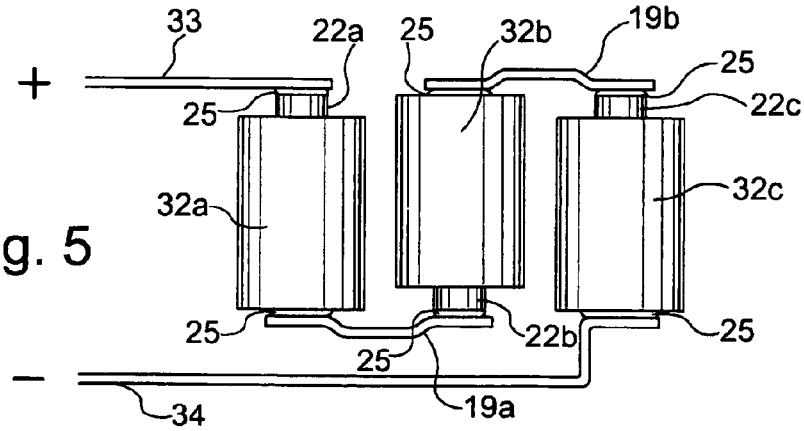
FIG. 5 represents one form of dry cell battery using three dry cells.

FIG. 3*a* is a top view of FIG. 3, alone the line 3*a*—3*a*. The strap 19 is connected to the post terminal at the toe 24. The post terminal is electrically insulated 30 from the can 32 of the dry cell 20. FIG. 5 represents a three cell battery fabricated from three dry cells, connected in series connection. As is well known, a dry cell has two terminals, the central terminal represented by the post terminals 22*a*, 22*b* and 22*c*. The cans 32*a*, 32*b* and 32*c* also serve as terminals. The straps 19*a* and 19*b* connect negative and positive terminals of adjacent dry cells and provide physical stability of the battery. The leads 33 and 34 are connected to the post terminal of the first dry cell and to the can terminal of the last dry cell. Leads 33 and 34 are the terminals of the battery. A film of solder at 25 bonds the straps 19*a* and 19*b* to the cell terminals. It is apparent that the connector strip 33 may be bonded, or soldered to the post terminal 22*a* and that the connector strip 34 may be bonded or soldered to the can terminal 32*c*, using the same technology as described herein for bonding the dry cell strap 19 to the post terminal 22. Also the dry cell straps 19*a* and 19*b* may be soldered to the can terminals of the dry cells 32*a* and 32*b*, using the present invention. It will be apparent that the opening or split 21 in the coil 18 may be enlarged or narrowed, depending on the width of the members to be inserted into alignment with the coils 18*a* of the coil 18. FIG. 5*a* represents a battery fabricated from dry cells 32'*a*, 32'*b* and 32'*c* oriented in parallel connection with the post terminals 22'*a*. 22'*b* and 22'*c* of the dry cells oriented in unison.

In the foregoing description of the invention, referenced to the drawings, certain terms have been used for conciseness, clarity and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented or described.

Having now described a preferred embodiment of the invention, in terms of features, discoveries and principles, along with certain alternative construction and suggested changes, other changes that may become apparent to those skilled in the art may be made, without departing from the scope of the invention defined in the appended claims.

What is claimed is:

1. Apparatus for fabricating a dry cell battery from a plurality of dry cells by coupling terminals of adjacent dry cells both electrically and physically, said apparatus comprising:

a) a generator means for generating an alternate current energy in the microwave range of frequencies;

b) a coil means coupled to said generator means for receiving said alternating current energy and for creating a magnetic field about said coil means in response to receiving said alternating current energy, said coil means having a space between adjacent coils defining a coil split;

c) a strap means defined by a bridge means and a first toe at one end thereof and a second toe at another end thereof;

d) a plurality of dry cells in juxtaposition relationship, each dry cell of said plurality of dry cells having a first terminal means and a second terminal means;

e) said first toe of said strap means retained in soldering contact with said first terminal means of a first dry cell of said plurality of dry cells and said first toe and said first terminal means placed in said coil split for having induced, about said soldering contact, an heat generating energy for soldering said first toe to said first terminal means.

2. Apparatus as in claim 1 wherein said cell strap is bi-metallic in structure, having a core of substantially solid copper metal and a skin, bonded to said core, of chrome steel metal.

3. Apparatus for fabricating a dry cell battery, as in claim 1 and further comprising:

f) said second toe of said strap means retained in a second soldering contact with said second terminal means of a second dry cell of said plurality of dry cells and said second toe and said second terminal means placed in said coil split, after removal of said first toe and said first terminal means therefrom, for having induced, about said second contact, said heat generating energy for soldering said second toe to said second terminal means.

4. Apparatus for fabricating a dry cell battery, as in claim 3 and in which, said first terminal means of said first dry cell is a positive terminal of said first dry cell and said second terminal means of said second dry cell is a negative terminal of said second dry cell.

5. Apparatus for fabricating a dry cell battery, as in claim 3 and in which, said first terminal means of said first dry cell is a post terminal means and said second terminal means of said second dry cell is a can terminal means.

6. Apparatus for fabricating a dry cell battery, as in claim 3 and in which said first dry cell and said second dry cell are connected by said strap means in series electric connection.

7. Apparatus for fabricating a dry cell battery, as claim 3 and in which said first dry cell and said second dry cell are connected by said strap means in parallel electric connection.

8. Apparatus for fabricating a dry cell battery, as in claim 3 and in which said coil means is defined by a hollow tubing in coil configuration and said hollow tubing is sealed and contains a fluid coolant.

9. Apparatus for fabricating a dry cell battery as in claim 1 and in which said generator means generates an alternating current energy in the radio frequency range of frequencies.

* * * * *